US011549388B2

(12) United States Patent
Faisal et al.

(10) Patent No.: US 11,549,388 B2
(45) Date of Patent: Jan. 10, 2023

(54) INNER SHROUD ASSEMBLY FOR GAS TURBINE ENGINE VARIABLE VANE SYSTEM

(71) Applicant: Raytheon Technologies Corporation, Farmington, CT (US)

(72) Inventors: Mohammad G. Faisal, Palm Beach Gardens, FL (US); David Maliniak, Guilford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 17/151,425

(22) Filed: Jan. 18, 2021

(65) Prior Publication Data

US 2022/0228507 A1 Jul. 21, 2022

(51) Int. Cl.
*F01D 17/16* (2006.01)
*F01D 25/26* (2006.01)

(52) U.S. Cl.
CPC ..... *F01D 17/165* (2013.01); *F01D 25/26* (2013.01); *F05D 2240/11* (2013.01); *F05D 2240/12* (2013.01); *F05D 2240/14* (2013.01); *F05D 2260/30* (2013.01)

(58) Field of Classification Search
CPC ..... F01D 17/16; F01D 17/162; F01D 17/165; F01D 25/26; F05D 2260/30
See application file for complete search history.

(56) References Cited

U.S. PATENT DOCUMENTS

| | | | | |
|---|---|---|---|---|
| 5,062,767 | A | 11/1991 | Worley et al. | |
| 6,129,512 | A * | 10/2000 | Agram | F01D 17/162 415/160 |
| 8,328,512 | B2 * | 12/2012 | Major | F01D 17/162 415/209.4 |
| 8,500,394 | B2 | 8/2013 | Major et al. | |
| 9,790,806 | B2 * | 10/2017 | Champion | F01D 25/246 |
| 9,840,928 | B2 | 12/2017 | Brummitt-Brown et al. | |
| 10,066,668 | B2 | 9/2018 | Zotz | |
| 10,364,827 | B2 | 7/2019 | Humhauser et al. | |
| 2007/0286719 | A1 | 12/2007 | Duesler et al. | |
| 2016/0123188 | A1 * | 5/2016 | Maliniak | F01D 25/243 415/209.4 |

OTHER PUBLICATIONS

EP Search Report dated Apr. 13, 2022 issued for corresponding European Patent Application No. 21208324.0.

* cited by examiner

*Primary Examiner* — Christopher Verdier
*Assistant Examiner* — Maxime M Adjagbe
(74) *Attorney, Agent, or Firm* — Bachman & LaPointe, P.C.

(57) ABSTRACT

An inner shroud assembly of a variable vane actuation system for a gas turbine engine includes a shroud assembly comprising a multiple of forward shroud segments and a respective multiple of aft shroud segments. A multiple of variable vanes are rotationally retained at an inboard trunion between the forward and aft shroud segments of the shroud assembly. A retainer assembly includes a multiple of retainer ring segments that retain the forward and aft shroud segments together. The inner shroud assembly is assembled into an engine case with an inboard extending feature that engages with an outer diameter feature of each of the multiple of retainer ring segments.

20 Claims, 9 Drawing Sheets

INNER SHROUD ASSEMBLY FOR GAS TURBINE ENGINE VARIABLE VANE SYSTEM

U.S. GOVERNMENT RIGHTS

This invention was made with Government support awarded by the United States. The Government has certain rights in this invention.

BACKGROUND

The present disclosure relates to a gas turbine engine and, more particularly, to an inner shroud assembly therefor.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

Some gas turbine engines include variable vane systems with vanes that can be rotated about their individual axes to change an operational performance characteristic. The variable vanes are robustly designed to handle the forces required to change the position of the vanes. A mechanical linkage is typically utilized to rotate the variable vanes. Although operationally effective, variable vane systems are relatively complicated to assemble and include numerous components and fasteners that must accommodate relatively significant forces.

SUMMARY

An inner shroud assembly of a variable vane actuation system for a gas turbine engine, according to one disclosed non-limiting embodiment of the present disclosure includes a shroud assembly comprising a multiple of forward shroud segments and a respective multiple of aft shroud segments; a multiple of variable vanes rotationally retained at an inboard trunion between the forward and aft shroud segments of the shroud assembly; and a retainer assembly comprising a multiple of retainer ring segments that retain the forward and aft shroud segments together.

A further aspect of the present disclosure includes that the multiple of retainer ring segments slide over the shroud assembly.

A further aspect of the present disclosure includes that the multiple of retainer ring segments are each 90 degree segments.

A further aspect of the present disclosure includes that the multiple of forward shroud segments and a respective multiple of aft shroud segments are 60 degree segments.

A further aspect of the present disclosure includes an anti-rotation lug on at least two of the aft shroud segments to receive a recess on an end section of two retainer ring segments.

A further aspect of the present disclosure includes an axial interface feature that extends from an outer diameter of each of the multiple of retainer ring segments.

A further aspect of the present disclosure includes that the axial interface feature comprises a ramped surface.

A further aspect of the present disclosure includes that the axial interface feature is engageable with a corresponding ramped surface on a feature of an intermediate case (IMC) of the gas turbine engine.

A further aspect of the present disclosure includes that each pair of forward and aft shroud segments are aligned via two or more alignment pins that are arranged within respective apertures that are axially parallel to the engine central longitudinal axis.

A gas turbine engine according to one disclosed non-limiting embodiment of the present disclosure includes an engine case with a ramped surface on an inboard extending feature; and an inner shroud assembly of a variable vane actuation system, the inner shroud assembly comprises an axial interface feature that extends from an outer diameter of each of a multiple of retainer ring segments, the axial interface feature comprises a ramped surface that engages with the ramped surface on the inboard extending feature.

A further aspect of the present disclosure includes that the multiple of retainer ring segments are each 90 degree segments.

A further aspect of the present disclosure includes a shroud assembly comprising a multiple of forward shroud segments and a respective multiple of aft shroud segments, the multiple of retainer ring segments operable to retain the forward and aft shroud segments together.

A further aspect of the present disclosure includes that the multiple of forward shroud segments and a respective multiple of aft shroud segments are 60 degree segments.

A further aspect of the present disclosure includes that the multiple of forward shroud segments and the respective multiple of the aft shroud segments are manufactured of a non-metallic material.

A further aspect of the present disclosure includes a multiple of variable vanes rotationally retained at an inboard trunion between the forward and aft shroud segments of the shroud assembly.

A further aspect of the present disclosure includes that the engine case is an intermediate case (IMC) of the gas turbine engine.

A method of assembling a variable vane actuation system according to one disclosed non-limiting embodiment of the present disclosure includes assembling a multiple of variable vanes between a respective forward and aft shroud segment of a shroud assembly, the shroud assembly comprising a multiple of shroud segments; sliding at least one of a multiple of forward and an aft shroud segments of the shroud assembly at least partially into a retainer ring segment, a multiple of retainer ring segments forming a retaining ring assembly of an inner shroud assembly, the inner shroud assembly comprises an axial interface feature with a ramped surface that extends from an outer diameter of each of a multiple of retainer ring segments; and assembling the inner shroud assembly into an engine case with a ramped surface on an inboard extending feature that engages with the ramped surface that extends from the outer diameter of each of the multiple of retainer ring segments.

A further aspect of the present disclosure includes that the engine case is a split case.

A further aspect of the present disclosure includes that the engine case is an intermediate case (IMC) of the gas turbine engine.

A further aspect of the present disclosure includes that the inner shroud assembly is retained within the engine case without fasteners between the retaining ring assembly and the engine case.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
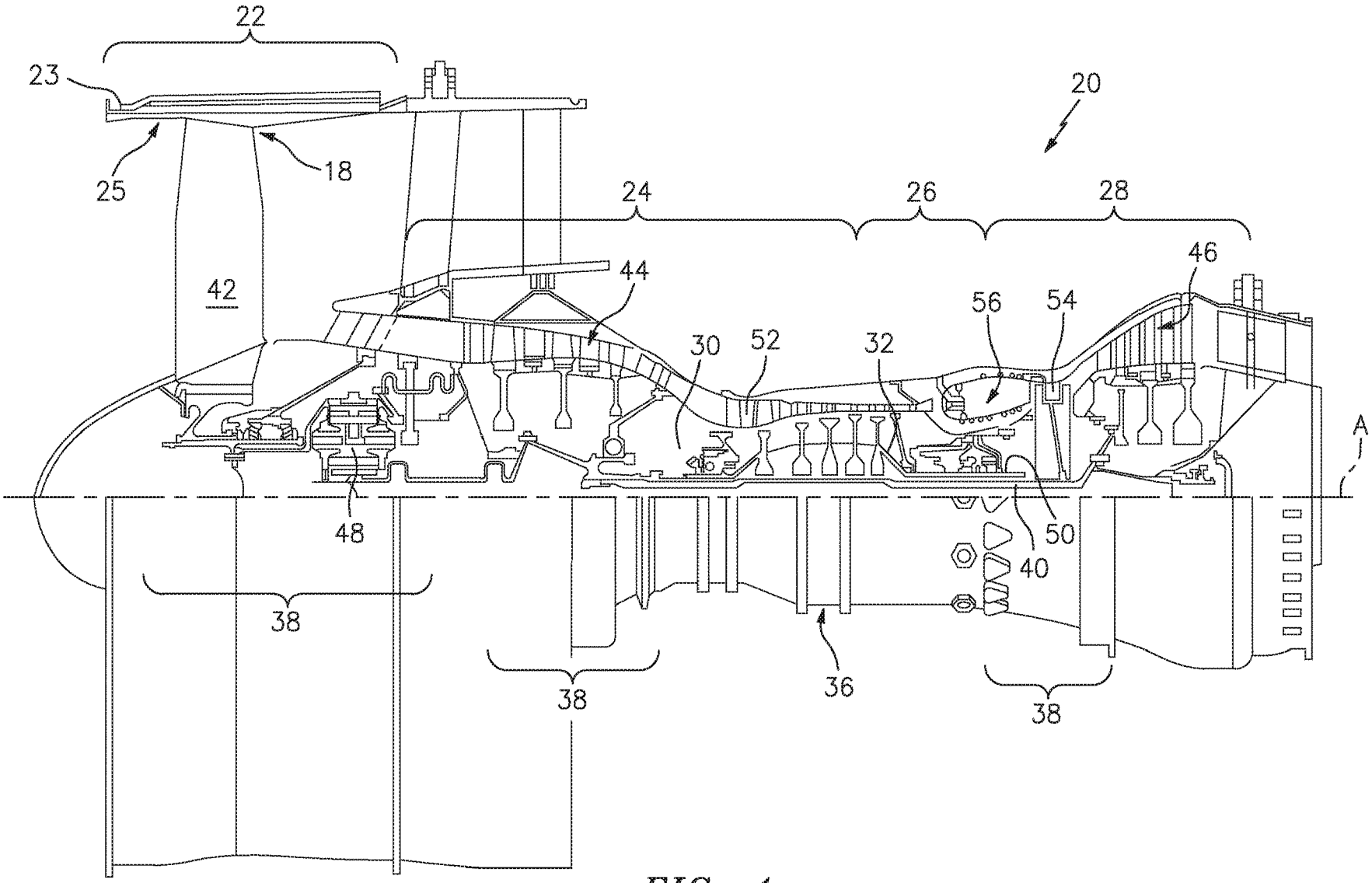
FIG. 1 is a schematic cross-section of an example gas turbine engine architecture.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein are not limited to use with turbofans as the teachings may be applied to other turbine engine architectures.

The engine 20 generally includes a low spool 30 and a high spool 32 mounted for rotation about an engine central longitudinal axis A relative to an engine case structure 36 via several bearing compartments 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the LPC 44 then the HPC 52, mixed with the fuel and burned in the combustor 56, then expanded over the HPT 54 and the LPT 46. The HPT 54 and the LPT 46 rotationally drive the respective high spool 32 and low spool 30 in response to the expansion.

Figure 2:
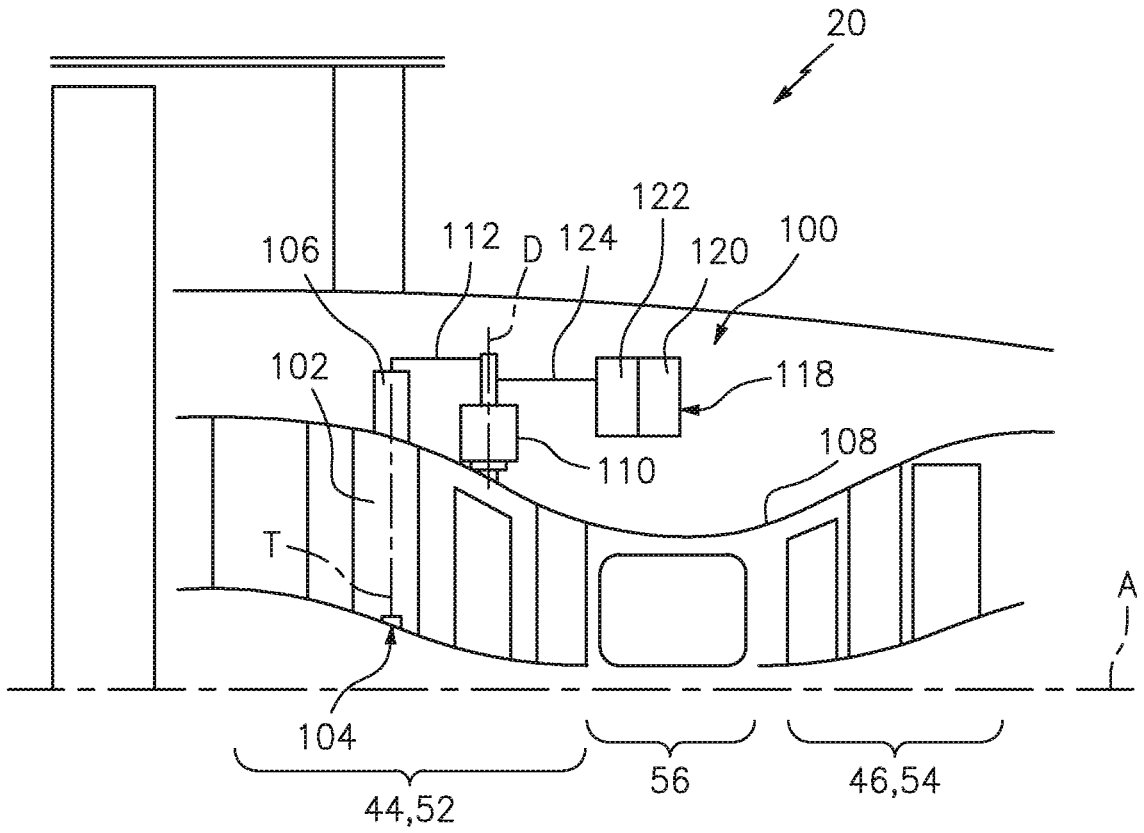
FIG. 2 is a schematic view of a variable vane system for a gas turbine engine.

With reference to FIG. 2, one or more stages of the LPC 44 and/or the HPC 52 include a variable vane system 100. The variable vane system 100 includes a plurality of variable vanes 102 that can be rotated to change an operational performance characteristic of the gas turbine engine 20 for different operating conditions. The plurality of variable vanes 102 (also shown in FIG. 3) circumferentially arranged around the engine central axis A. The variable vanes 102 each include an airfoil portion of which one side may operate as a suction side and the opposing side may operate as a pressure side. Each of the variable vanes 102 spans the core flow path between an inner diameter and an outer diameter relative to the engine central axis A.

Each of the variable vanes 102 includes an inner trunion 104 that is receivable into a corresponding socket in an inner shroud assembly 114 and an outer trunion 106 mounted to an outer engine case 108 such that each of the variable vanes 102 can rotate about a vane axis T. The inner shroud assembly 114 defines the inner diameter of the flowpath and supports the vane inner trunnions 104 in a circumferentially spaced relationship.

The variable vane system 100 may further include a synchronizing ring assembly 110 to which, in one disclosed non-limiting embodiment, each of the outer trunions 106 are attached through a vane arm 112 along a respective axis D. The variable vane system 100 is driven by an actuator system 118 with an actuator 120, a drive 122, and an actuator arm 124. Rotation of the synchronizing ring assembly 110 about the engine axis A drives the vane arm 112 to rotate the outer trunion 106 of each of the variable vanes 102. Although particular components are separately described, it should be appreciated that alternative or additional components may be provided.

Figure 3:
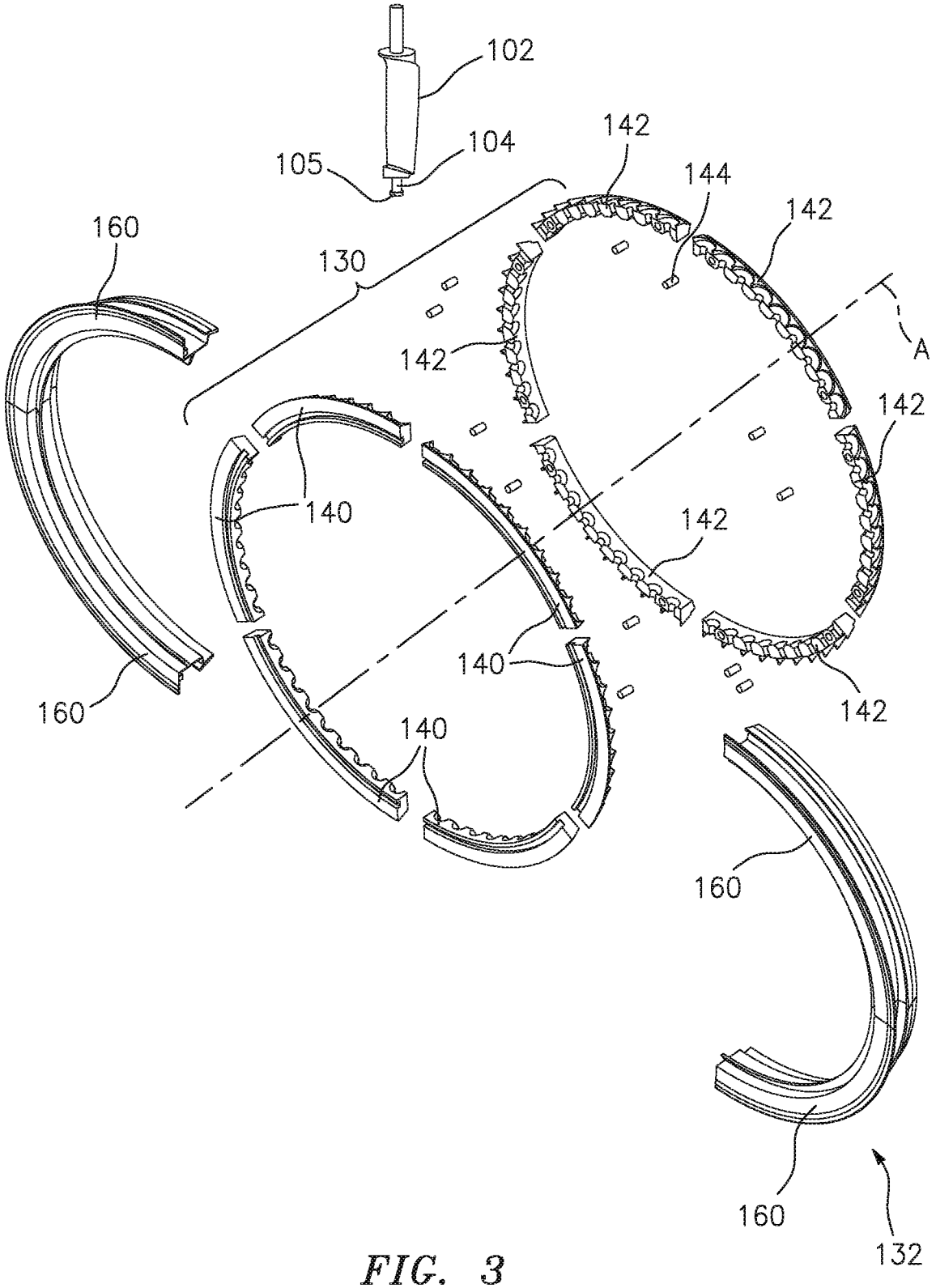
FIG. 3 is an exploded view of an inner shroud assembly of a variable vane system for a gas turbine engine.
Figure 4:
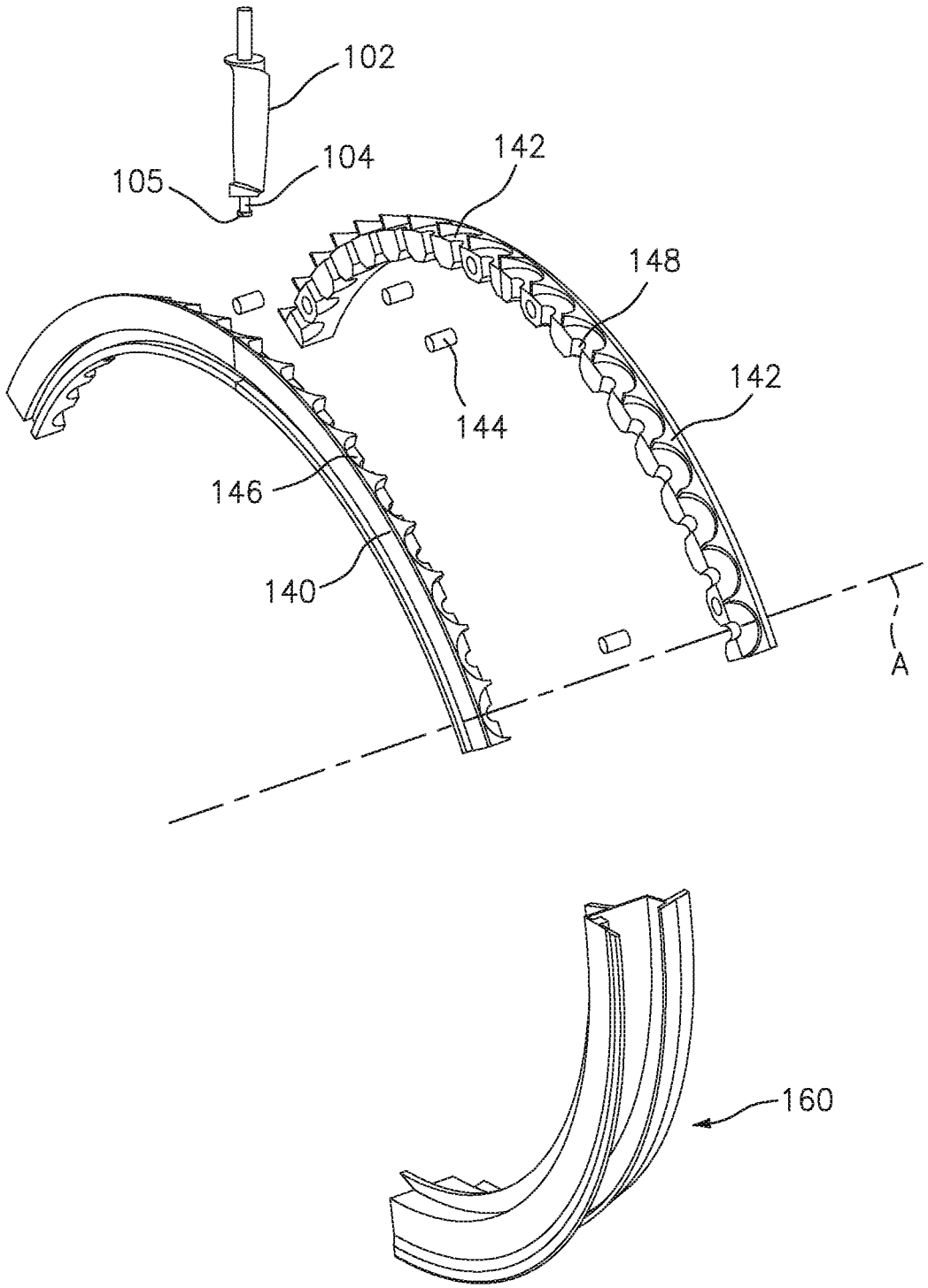
FIG. 4 is an exploded view of one segment of the inner shroud assembly.

With reference to FIG. 3, the inner shroud assembly 114 includes a shroud assembly 130 to retain the variable vanes 102 and a retainer assembly 132 that contains the shroud assembly 130. The shroud assembly 130 includes a multiple of forward shroud segments 140 and a respective multiple of aft shroud segments 142. Each of the forward and aft shroud segments 140, 142 in the illustrated embodiment may be 60 degree segments. Each pair of forward and aft shroud segments 140, 142 may be aligned by one or more alignment pins 144 (FIG. 4) that are arranged within respective apertures 146, 148 that are axially parallel to the engine central longitudinal axis A.

The shroud assembly 130 defines the inner flowpath and properly spaces the inner ends of the variable vanes 102. The shroud assembly 130 operates as a bearing material for each inner trunion 104 and may be manufactured of a ceramic matrix composite (CMC) or organic matrix composite (OMC) material. Examples of CMC materials include, but are not limited to, carbon-fiber-reinforced carbon (C/C), carbon-fiber-reinforced silicon carbide (C/SiC), silicon-carbide-fiber-reinforced silicon carbide (SiC/SiC), alumina-fiber-reinforced alumina (Al2O3/Al2O3), or combinations thereof.

Figure 5:
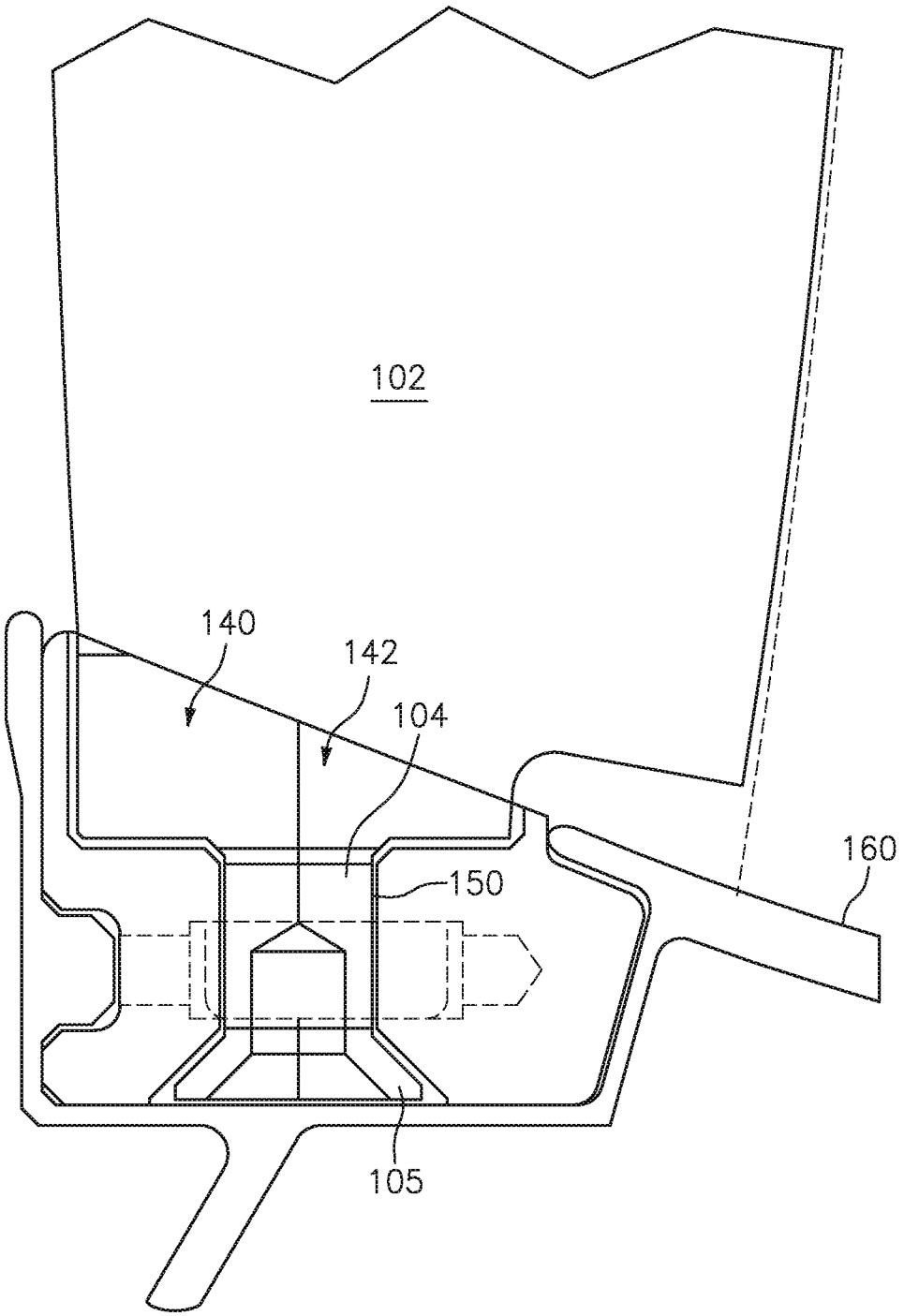
FIG. 5 is a sectional view of the inner shroud assembly.

Each inner trunion 104 may include a flange 105 that is radially retained by being sandwiched between the forward and aft shroud segments 140, 142 (FIG. 5). That is, a bore 150 formed by the assembly of the forward and aft shroud segments 140, 142 captures the flange 105 to prevent an inner portion of a broken vane from being liberated outward into the flowpath. The flange 105 and bore 150 in the illustrated embodiment are conical in shape.

Figure 6:
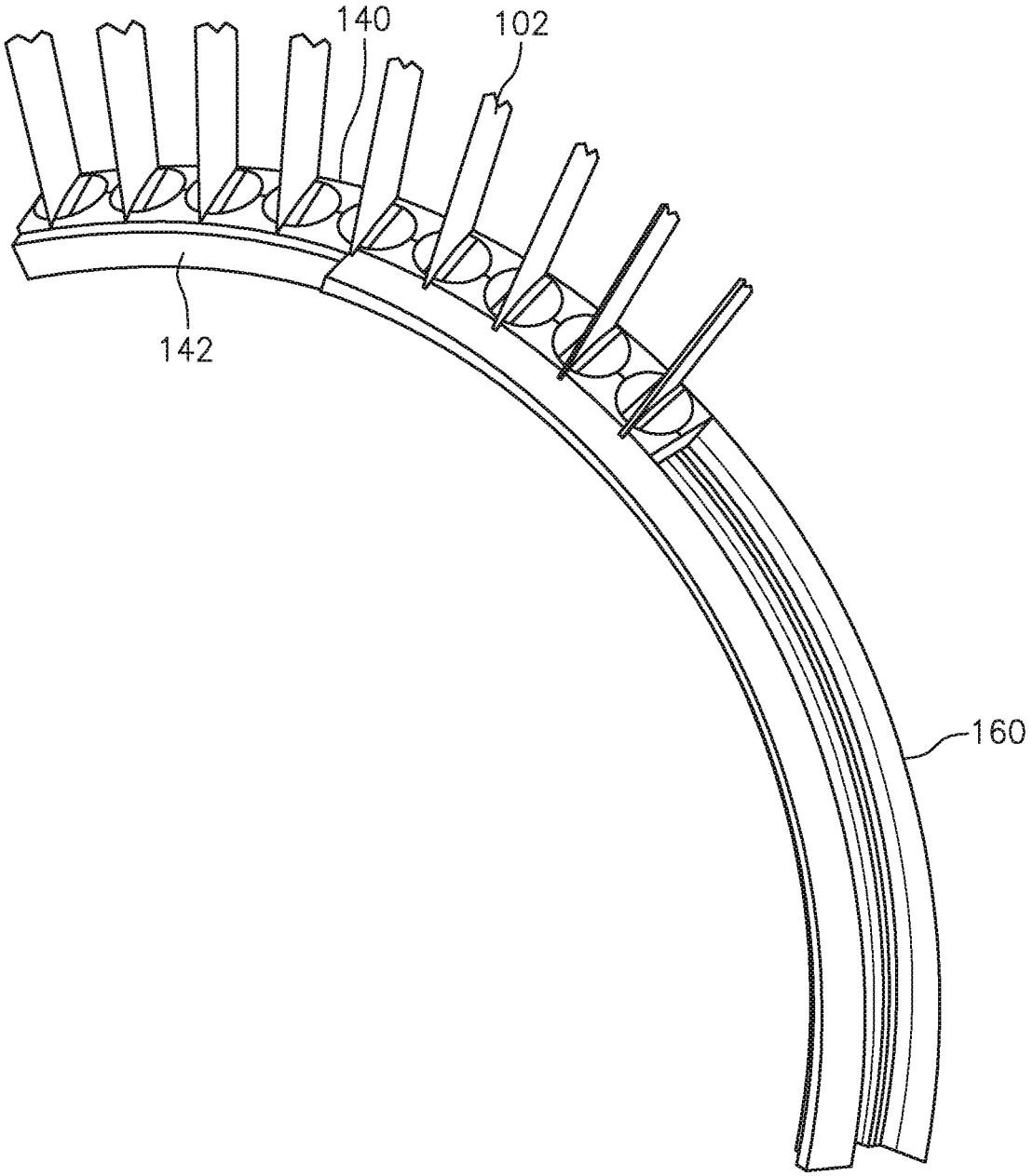
FIG. 6 is an expanded perspective view of one segment of the inner shroud assembly.

The retainer assembly 132 includes a multiple of retainer ring segments 160 that slide over the forward and aft shroud segments 140, 142 to retain together the forward and aft shroud segments 140, 142 (FIG. 6). In one embodiment, the multiple of retainer ring segments 160 may provide a line-to-line fit (e.g., an exact fit) with the forward and aft shroud segments 140, 142. In another embodiment, the multiple of retainer ring segments 160 may provide a small gap (e.g., a clearance fit) with the forward and aft shroud segments 140, 142. Each of the multiple of retainer ring segments 160 in the illustrated embodiment are 90 degree segments to minimize leakage based on legacy experience as well as to facilitate installation into the split case assembly of the compressor. The multiple of retainer ring segments 160 may be manufactured of a high strength and light weight material such as titanium.

Figure 7:
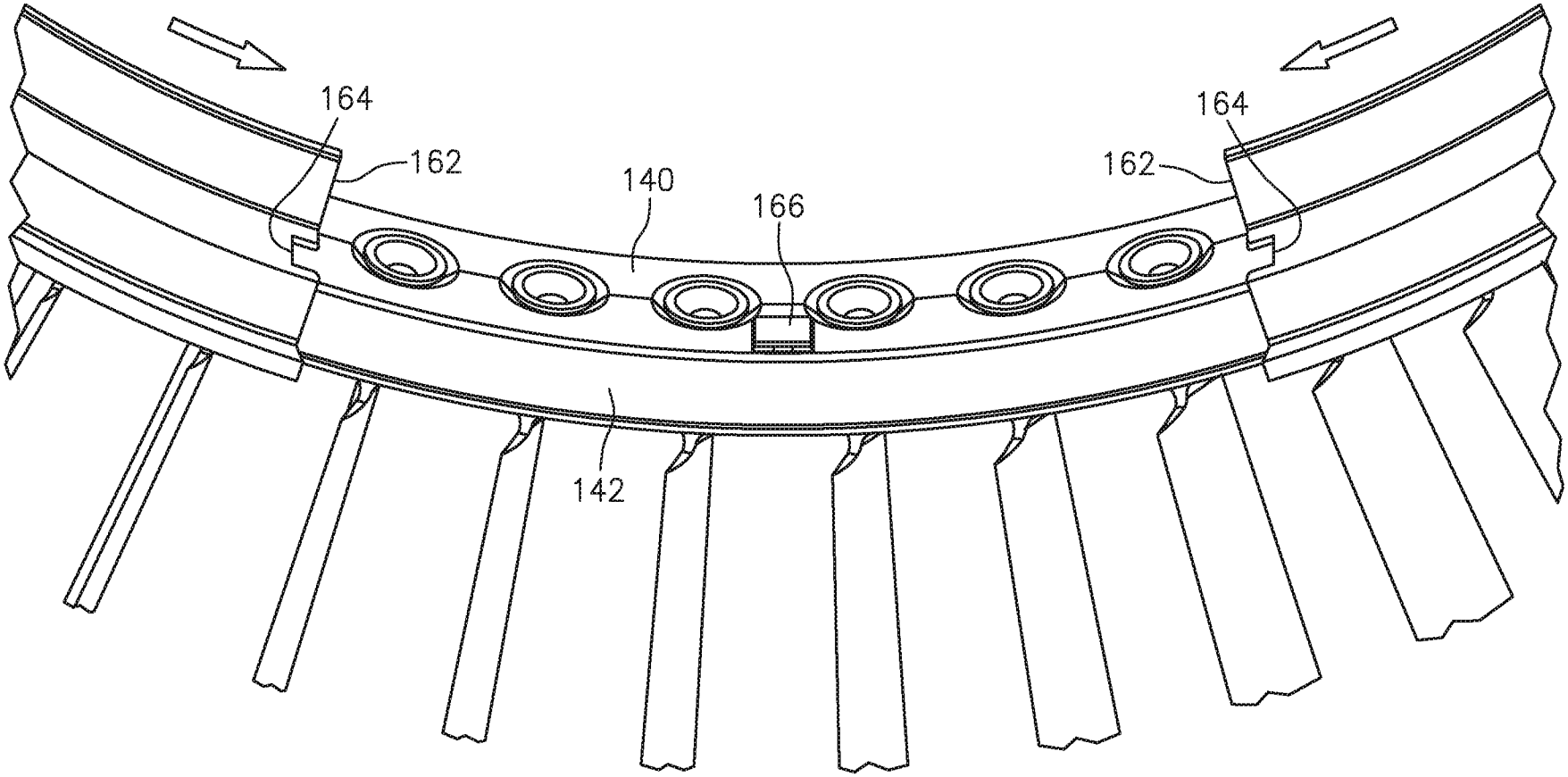
FIG. 7 is a partial assembled view of the inner shroud assembly illustrating an anti-rotation lug.

An end section 162 of each retainer ring segment 160 includes a recess 164 that engages an anti-rotation lug 166 formed on the aft shroud segments 142 (FIG. 7). The anti-rotation lug 166 may be rectilinear in cross section and is sandwiched between two adjacent retainer ring segments 160.

Figure 8:
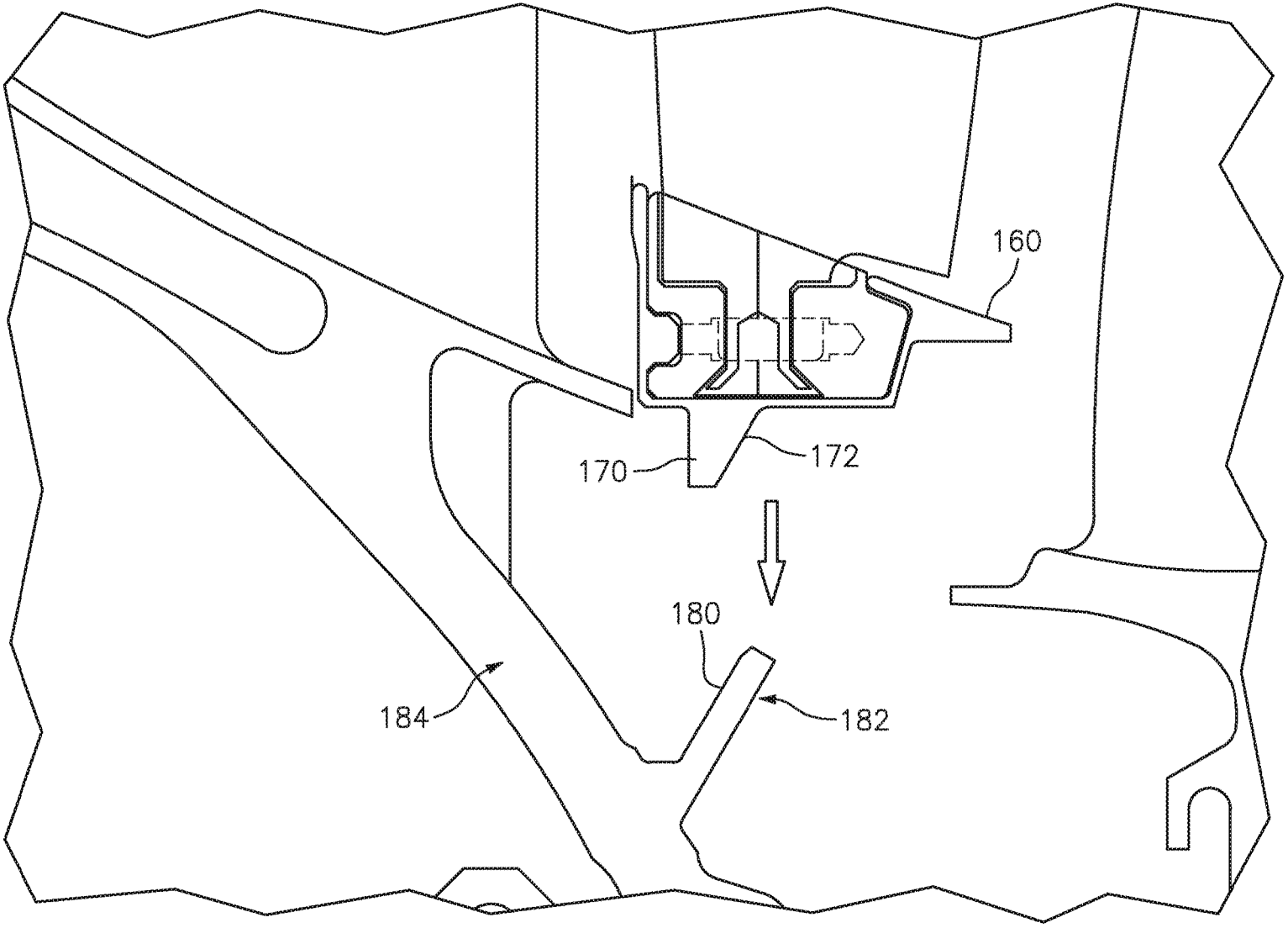
FIG. 8 is a sectional view of the inner shroud assembly just prior to assembly into an engine case.
Figure 9:
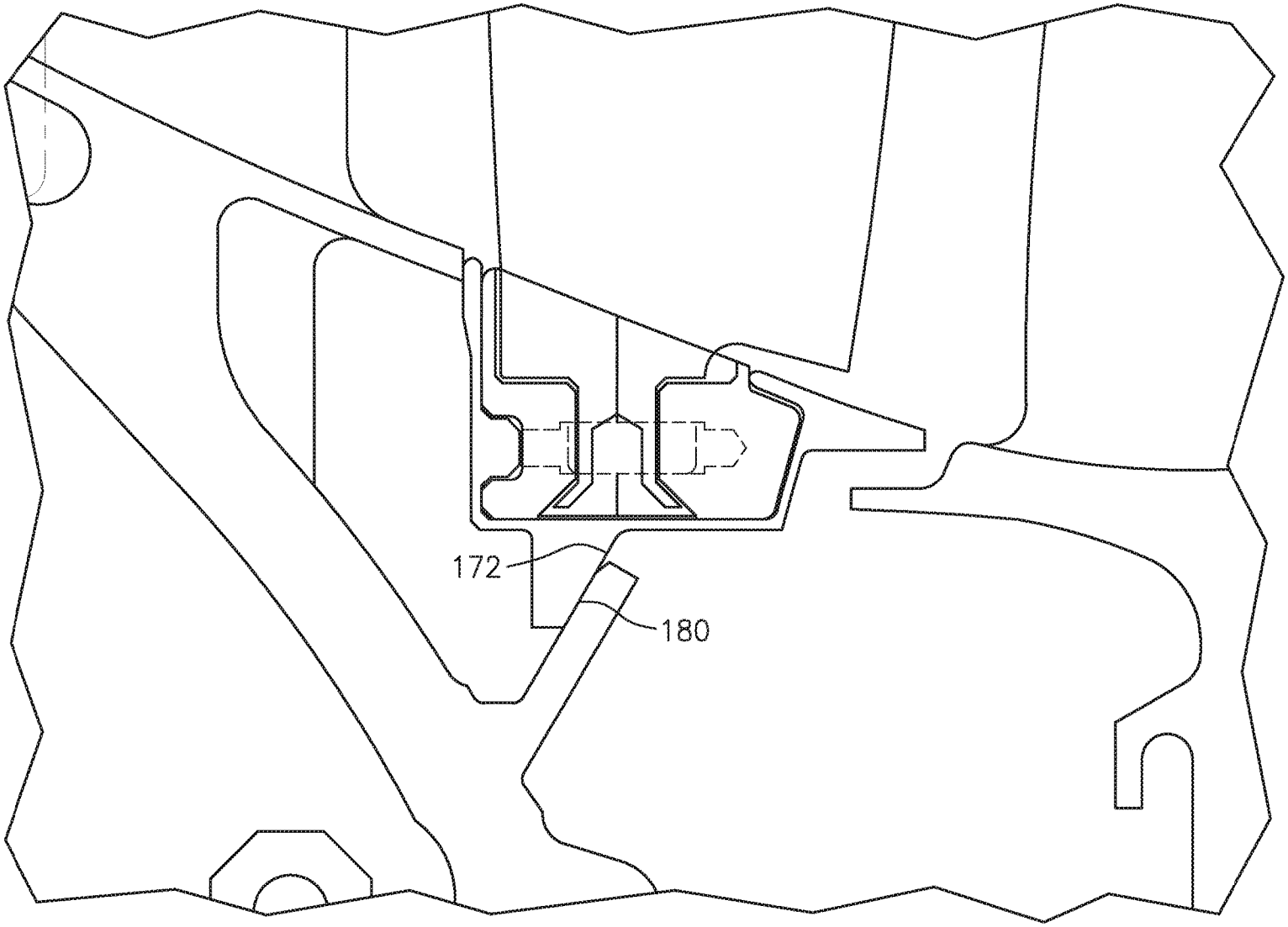
FIG. 9 is a sectional view of the inner shroud assembly assembled into the engine case.

With reference to FIG. 8, each of the multiple of retainer ring segments 160 includes an axial interface feature 170 with a ramped surface 172. The axial interface feature 170 extends from an outer diameter of each of the retainer ring segments 160 to form a full circular interface. The axial interface feature 170 engages with a corresponding ramped surface 180 on a corresponding interface 182 of a split case such as intermediate case (IMC) 184 (FIG. 9). The interface 182 extends radially inboard toward the engine central longitudinal axis A and may essentially form a portion of a "V" shape such that the forward facing ramped surface 180 abuts the aft facing ramped surface 172 to facilitate blind assembly of the inner shroud assembly 114 into the intermediate case (IMC) 184. This provides a light weight and robust interface that eliminates axial fasteners and inserts.

This inner shroud assembly 114 configuration eliminates axial fasteners and inserts and thereby reduces the assembly part count. In addition to the cost savings and weight decrease, there is no need for a table of limits for bolt torque during assembly.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed is:

1. An inner shroud assembly of a variable vane actuation system for a gas turbine engine, comprising:

a shroud assembly comprising a multiple of forward shroud segments and a respective multiple of aft shroud segments;

a multiple of variable vanes rotationally retained at an inboard trunion between the forward and aft shroud segments of the shroud assembly;

a retainer assembly comprising a multiple of retainer ring segments that retain the forward and aft shroud segments together; and an anti-rotation lug on at least two of the aft shroud segments and extending into a recess defined along end sections of two retainer ring segments to secure the multiple of retainer ring segments against relative rotation with respect to the shroud assembly.

2. The assembly as recited in claim 1, wherein the multiple of retainer ring segments slide over the shroud assembly.

3. The assembly as recited in claim 1, wherein the multiple of retainer ring segments are each 90 degree segments.

4. The assembly as recited in claim 1, wherein the multiple of forward shroud segments and a respective multiple of aft shroud segments are 60 degree segments.

5. The assembly as recited in claim 1, wherein the anti-rotation lug extends from a central portion of the aft shroud segments, and wherein the recess is defined in a central portion of the retainer assembly and is defined by a cutout in at least one end surface of a retainer ring segment.

6. The assembly as recited in claim 1, further comprising an axial interface feature that extends from an outer diameter of each of the multiple of retainer ring segments.

7. The assembly as recited in claim 6, wherein the axial interface feature comprises a ramped surface.

8. The assembly as recited in claim 6, wherein the axial interface feature is engageable with a corresponding ramped surface on a feature of an intermediate case (IMC) of the gas turbine engine.

9. The assembly as recited in claim 6, wherein each pair of forward and aft shroud segments are aligned via two or more alignment pins that are arranged within respective apertures that are axially parallel to the engine central longitudinal axis.

10. A gas turbine engine, comprising:

an engine case with a ramped surface on an inboard extending feature; and an inner shroud assembly of a variable vane actuation system, the inner shroud assembly comprises an axial interface feature that extends from an outer diameter of each of a multiple of retainer ring segments, the axial interface feature comprises a ramped surface that engages with the ramped surface on the inboard extending feature;

a multiple of forward shroud segments and a respective multiple of aft shroud segments, the multiple of retainer ring segments operable to retain the forward and aft shroud segments together; and an anti-rotation lug on at least two of the aft shroud segments and extending into a recess defined along end sections of two retainer ring segments to secure the multiple of retainer ring segments against relative rotation with respect to the shroud assembly.

11. The gas turbine engine as recited in claim 10, wherein the multiple of retainer ring segments are each 90 degree segments.

12. The gas turbine engine as recited in claim 10, wherein the anti-rotation lug extends from a central portion of the aft shroud segments, and wherein the recess is defined in a central portion of the retainer assembly and is defined by a cutout in at least one end surface of a retainer ring segment.

13. The gas turbine engine as recited in claim 12, wherein the multiple of forward shroud segments and a respective multiple of aft shroud segments are 60 degree segments.

14. The gas turbine engine as recited in claim 13, wherein the multiple of forward shroud segments and the respective multiple of the aft shroud segments are manufactured of a non-metallic material.

15. The gas turbine engine as recited in claim 13, further comprising a multiple of variable vanes rotationally retained at an inboard trunion between the forward and aft shroud segments of the shroud assembly.

16. The gas turbine engine as recited in claim 10, wherein the engine case is an intermediate case (IMC) of the gas turbine engine.

17. A method of assembling a variable vane actuation system, comprising:

assembling a multiple of variable vanes between a respective forward and aft shroud segment of a shroud assembly, the shroud assembly comprising a multiple of shroud segments;

sliding at least one of a multiple of forward and aft shroud segments of the shroud assembly at least partially into a retainer ring segment, a multiple of retainer ring segments forming a retaining ring assembly of an inner shroud assembly, the inner shroud assembly comprises an axial interface feature with a ramped surface that extends from an outer diameter of each of a multiple of retainer ring segments, wherein an anti-rotation lug on at least two of the aft shroud segments extends into a recess defined along end sections of two retainer ring segments to secure the multiple of retainer ring segments against relative rotation with respect to the shroud assembly; and assembling the inner shroud assembly into an engine case with a ramped surface on an inboard extending feature that engages with the ramped surface that extends from the outer diameter of each of the multiple of retainer ring segments.

18. The method as recited in claim 17, wherein the engine case is a split case.

19. The method as recited in claim 18, wherein the engine case is an intermediate case (IMC) of the gas turbine engine.

20. The method as recited in claim 18, wherein the inner shroud assembly is retained within the engine case without fasteners between the retaining ring assembly and the engine case.

* * * * *